US007371311B2

(12) United States Patent
Zierath et al.

(10) Patent No.: US 7,371,311 B2
(45) Date of Patent: May 13, 2008

(54) MODIFIED ELECTROPLATING SOLUTION COMPONENTS IN A LOW-ACID ELECTROLYTE SOLUTION

(75) Inventors: Daniel J Zierath, Portland, OR (US); Vinay Chikarmane, Portland, OR (US); Valery M Dubin, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 127 days.

(21) Appl. No.: 10/682,276

(22) Filed: Oct. 8, 2003

(65) Prior Publication Data

US 2005/0077181 A1 Apr. 14, 2005

(51) Int. Cl.
*C25D 3/38* (2006.01)
*C25D 21/18* (2006.01)

(52) U.S. Cl. ..... 205/81; 205/101; 205/296

(58) Field of Classification Search ..... 205/81
See application file for complete search history.

(56) References Cited

U.S. PATENT DOCUMENTS 4,913,787 A * 4/1990 Kiso ..... 205/267
6,808,611 B2 * 10/2004 Sun et al. ..... 205/81
6,921,551 B2 * 7/2005 Basol ..... 427/97.1
6,946,065 B1 * 9/2005 Mayer et al. ..... 205/102
2001/0015321 A1 * 8/2001 Reid et al. ..... 205/103
2002/0112964 A1 * 8/2002 Gandikota et al. ..... 205/118
2005/0016857 A1 * 1/2005 Kovarsky et al. ..... 205/98
2006/0081475 A1 * 4/2006 Barstad et al. ..... 205/102

OTHER PUBLICATIONS

F. A. Lowenheim, Electroplating, McGraw-Hill Book Co. New York, 1978, pp. 201-202.*

* cited by examiner

*Primary Examiner*—Susy Tsang-Foster
*Assistant Examiner*—William T. Leader
(74) *Attorney, Agent, or Firm*—Blakely, Sokoloff, Taylor & Zafman LLP

(57) ABSTRACT

An embodiment of the invention provides a method for reducing within die thickness variations by modifying the concentration of components of a low-acid electroplating solution. For one embodiment, the leveler concentration is increased sufficiently to reduce within die thickness variations to a specified value. For one embodiment of the invention, the leveler and suppressor are increased to reduce within die thickness variations and substantially reduce a plurality of electroplating defects. In such an embodiment the combined concentration of leveler and suppressor is determined to maintain adequate gap fill.

7 Claims, 4 Drawing Sheets

| Electroplating Solution Component | Concentration |
|---|---|
| Sulfuric Acid | 10g/L |
| Copper | 40g/L |
| Chloride | 50mg/L |
| Accelerator | 1.5mL/L |
| Leveler | 8mL/L |
| Suppressor | 3.3mL/L |

Low-Acid Electroplating Solution

FIG. 2
(PRIOR ART)

MODIFIED ELECTROPLATING SOLUTION COMPONENTS IN A LOW-ACID ELECTROLYTE SOLUTION

RELATED APPLICATIONS

This application is related to copending U.S. application Ser. No. 10/682,275, filed on Oct. 8, 2003, entitled "MODIFIED ELECTROPLATING SOLUTION COMPONENTS IN A HIGH-ACID ELECTROLYTE SOLUTION".

FIELD

Embodiments of the invention relate generally to the field of electroplating integrated substrates and more particularly to methods for reducing defects by adjusting electroplating solution components in a high-acid electrolyte solution.

BACKGROUND

During the manufacture of integrated circuits, a semiconductor wafer is deposited with a conductive metal to provide interconnects between the integrated components. Aluminum deposition may be used for this purpose. Copper has recently been found to offer distinct advantages over aluminum as a conductive plating for an integrated circuit substrate. Copper is more conductive than aluminum and can be plated into much smaller features (e.g., trenches and vias) having high aspect ratios. This is an important advantage given the trend toward smaller features. Moreover, the deposition process for aluminum is more costly and complex, requiring thermal processing within a vacuum, whereas electroplating can be used to effect copper plating of semiconductor wafers.

The use of copper plating, however, is not without drawbacks. Two related drawbacks are the problems of proper gap fill and within die ("WID") thickness variation of the copper plating.

Within Die Thickness Variation

Prior to plating, the semiconductor wafer is patterned with vias and trenches that form the interconnects. With typical conformal electroplating, the electroplate metal will grow at a similar rate over the entire surface being plated. If the surface is not flat, the metal will follow the contours of the surface. Conformal electroplating is not suitable for surfaces having small features, as it tends to result in poor gap fill. That is, such electroplating leaves a seam or hole inside the feature at the end of the plating. FIG. 1A illustrates the drawbacks of conformal electroplating for surfaces having small features in accordance with the prior art. As shown in FIG. 1A, the substrate 100 has a number of features labeled 105A-105D that may be trenches or vias. A copper layer 110 is formed on substrate 100 using electroplating. Using conformal electroplating may cause holes (voids) 106, as shown in features 105A and 105C, or seams 107, as shown in features 105B and 105D, to form over the features. This problem is more pronounced for smaller features and higher aspect ratios.

To address the problem of poor gap fill (i.e., seams and voids in the copper plating), a suppressant and accelerator are added to the electroplating bath to suppress copper plating outside the features (in the field regions 115) while accelerating copper deposition at the bottom of the features. The accelerator allows the copper plating to grow faster from within the features, filling the features from the bottom up to avoid the formation of holes and seams in the copper plating. Electroplating using the accelerator is known as bottom-up superfill or momentum electroplating. While the use of accelerator can improve gap fill (i.e., reduce the occurrence of voids and seams), because the copper plating continues to grow at a faster rate over the features even after filling the features, a "hump" may be formed over the features, causing a with-in-die WID thickness variation. WID thickness variation is the step height difference between the copper plating area over a feature region and the copper plating area over a field region. FIG. 1B illustrates WID thickness variations in the copper plating due to momentum electroplating in accordance with the prior art. As shown in FIG. 1B, substrate 120 has a number of features labeled 125A-125D that may be trenches or vias. A copper layer 130 is formed on substrate 120 using electroplating. Using momentum electroplating while avoiding holes and seams causes a WID thickness variation 135 over each feature. WID thickness variations typically range from 100-250 nm.

Another drawback of electroplating is the problem of defects on the copper plating. These defects include wetting-related defects and copper protrusions. Wetting-related defects include, for example, "pit" or "crater" defects, which are holes in the copper plating that extends to the seed layer. The unplated area of the wafer will be destroyed in subsequent processing, so substrates having such defects in their copper plating may be discarded. Copper protrusions are bumps resulting from high-growth copper grains in the seed layer that are replicated on the plating surface. The copper protrusions are typically 20-50 nm in diameter and protrude from the plating surface approximately 50-500 nm.

Typical prior art electroplating solutions contain sulfuric acid with a concentration of approximately 175 grams per liter ("g/l"). This relatively high acid concentration provides high conductivity but can lead to difficulties for larger wafer sizes. For larger wafers (e.g., 12"), the resistance of the wafer and seed layer increases from the edge to the center, which may cause a greater electroplating at the edge of the wafer. This problem is exacerbated when seed layer resistance increases as seed layer thickness is scaled down to aide in gap fill in small features. This problem, known as terminal effect, has led to a trend toward low-acid electroplating solutions. FIG. 2 illustrates a typical low-acid/high copper electroplating solution in accordance with the prior art. As shown in FIG. 2, the electroplating solution has a number of inorganic components (e.g., acid, copper, and chloride) and a number of organic components (e.g., accelerator, leveler, and suppressor). This typical prior solution is known as a low-acid/high copper electrolyte solution by comparison to the acid concentrations of previous electroplating solutions that use considerably more acid. Generally a low-acid electroplating solution has a sulfuric acid concentration of less than 20 g/l and more typically about 10 g/l. With the exception of the decrease in the acid concentration and an increase in the copper concentration as discussed above, the various components and concentrations for the solution were developed over time for various electroplating processes. With the continuing trend toward smaller feature size, higher aspect ratios, and seed scaling, the concentrations of various components of the prior art electroplating solution may not be ideal for such applications.

BRIEF DESCRIPTION OF THE DRAWINGS

The invention may be best understood by referring to the following description and accompanying drawings that are used to illustrate embodiments of the invention. In the drawings:

FIG. 2 illustrates a typical low-acid electroplating solution in accordance with the prior art;

DETAILED DESCRIPTION

Embodiments of the invention provide methods for reducing electroplating defects by varying the concentration of components in a low-acid electroplating solution. For one embodiment, the concentration of leveler is increased, resulting in a decrease in WID thickness variations. In an alternative embodiment, the concentration of suppressant is increased resulting in reduced occurrence of protrusions and wetting-related defects. Various alternative embodiments include an increased concentration of leveler together with varying concentrations of other components, as well as varying other portions of the electroplating process to further reduce defects.

In the following description, numerous specific details are set forth. However, it is understood that embodiments of the invention may be practiced without these specific details. In other instances, well-known techniques have not been shown in detail in order not to obscure the understanding of this description.

Reference throughout the specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout the specification are not necessarily all referring to the same embodiment. Furthermore, the particular features, structures, or characteristics may be combined in any suitable manner in one or more embodiments.

Moreover, inventive aspects lie in less than all features of a single disclosed embodiment. Thus, the claims following the Detailed Description are hereby expressly incorporated into this Detailed Description, with each claim standing on its own as a separate embodiment of this invention.

Leveler

Figure 1A:
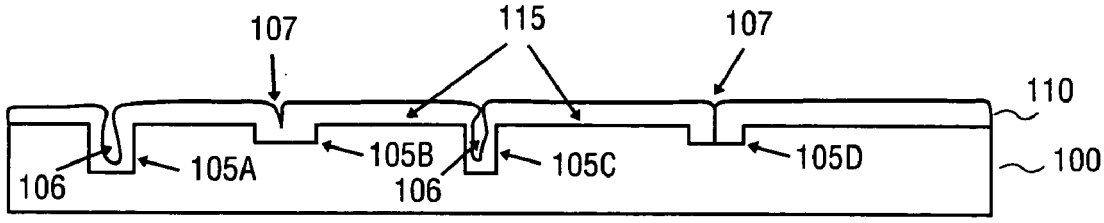
FIG. 1A (PRIOR ART)
FIG. 1A illustrates the drawbacks of conformal electroplating for surfaces having small features in accordance with the prior art.
Figure 1B:
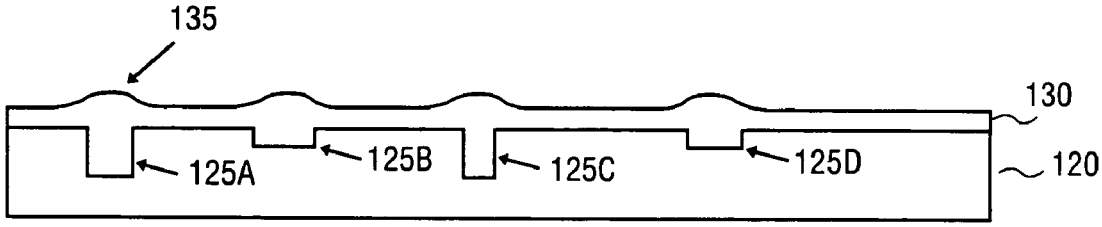
FIG. 1B (PRIOR ART)
FIG. 1B illustrates WID thickness variations in the copper plating due to momentum electroplating in accordance with the prior art.
Figure 3:
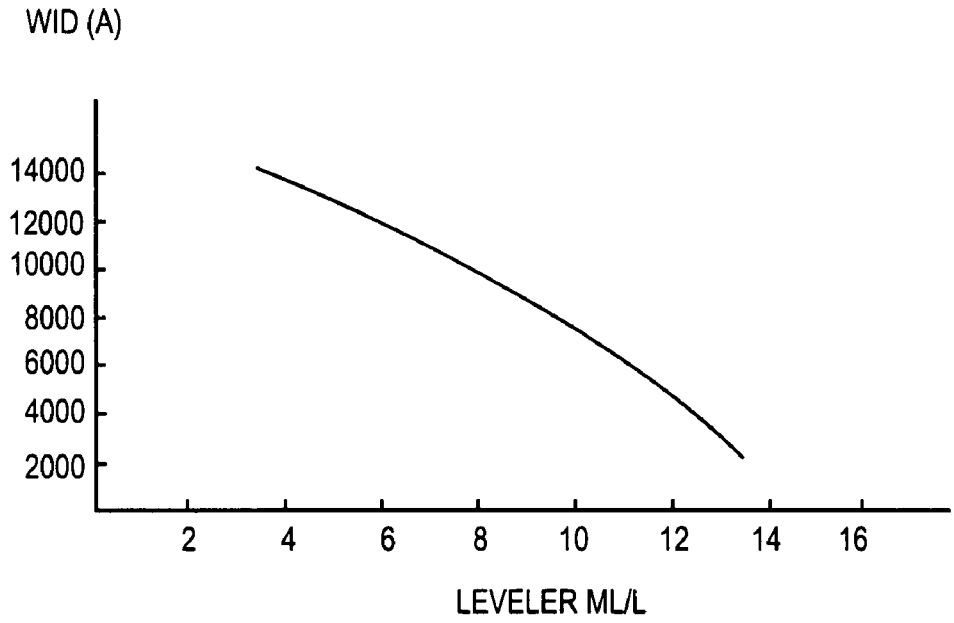
FIG. 3 illustrates the relationship between the leveler concentration and within die thickness variation in accordance with one embodiment of the invention.

The prior art electroplating solution also typically includes a leveler concentration of approximately 8 ml/l. In the prior art electroplating solution, leveler serves to reduce stress-related voiding defects. The prior art concentration of leveler (i.e., 8 ml/l) has no discernible effect upon WID thickness variation. Experimentally, increased leveler concentration from 8-12 ml/l reduces the WID thickness variation. FIG. 3 illustrates the relationship between the leveler concentration and within die thickness variation in accordance with one embodiment of the invention. As shown in FIG. 3, the WID thickness variation decreases from approximately 12,000 Angstroms, with a leveler concentration below 4 ml/l, to approximately 2000 Angstroms for a leveler concentration above 12 ml/l. However, the leveler concentration cannot be increased beyond a certain point without causing increased gap fill problems due to an overabundance of carbon in the electroplating solution. The degree to which the leveler concentration can be increased without experiencing deficient gap fill is dependent upon the type and amount of the electroplating metal. Experimentally it is determined that, for a low-acid (hence high copper) electroplating solution, a leveler concentration of 15-20 ml/l will substantially reduce WID thickness variation without causing gap fill problems.

Suppressor

As discussed above, the prior art electroplating solution includes a suppressor concentration of approximately 3.3 ml/l. The suppressor is used in gap fill in conjunction with the accelerator to accelerate copper deposition at the bottom of the features while suppressing copper plating outside the features. The suppressor also acts as a surfactant to lower the surface tension and provide better electroplating.

Figure 4:
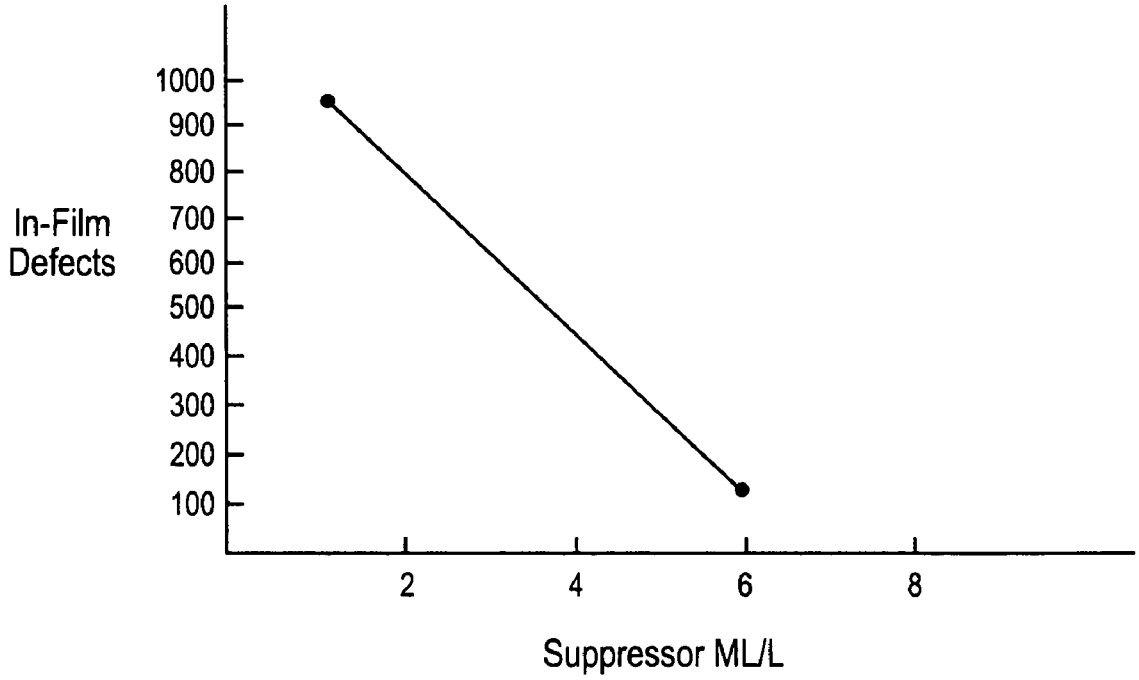
FIG. 4 illustrates the relationship between suppressor concentration, in conjunction with a leveler concentration of approximately 12 milliliters per liter ("ml/l"), and the occurrence of in-film defects in the electroplating in accordance with one embodiment of the invention.

As with the high-acid electroplating solution, defect levels are a strong function of suppressor. However, as with the leveler, the concentration cannot be increased beyond a certain point without a detrimental affect on gap fill. Moreover, because leveler and suppressor are both organic components, the concentration of both have to be considered in maintaining the carbon level of the electroplating solution sufficiently low so as to provide adequate gap fill. That is, the concentrations of leveler and suppressor should be determined in respect to one another. Experimentally, for a low-acid electroplating solution, a substantial reduction in WID thickness variation and defects is achieved with a suppressor level in the range of 3.3 ml/l-6 ml/l in conjunction with a leveler concentration in the range of 8 ml/l-12 ml/l. FIG. 4 illustrates the relationship between suppressor concentration, in conjunction with a leveler concentration of approximately 12 ml/l, and the occurrence of in-film defects in the electroplating in accordance with one embodiment of the invention. As shown in FIG. 4, the occurrence of in-film defects decreases from approximately 900 with a suppressor level of 1 ml/l to approximately 100 for a suppressor concentration of 6 ml/l.

Figure 5:
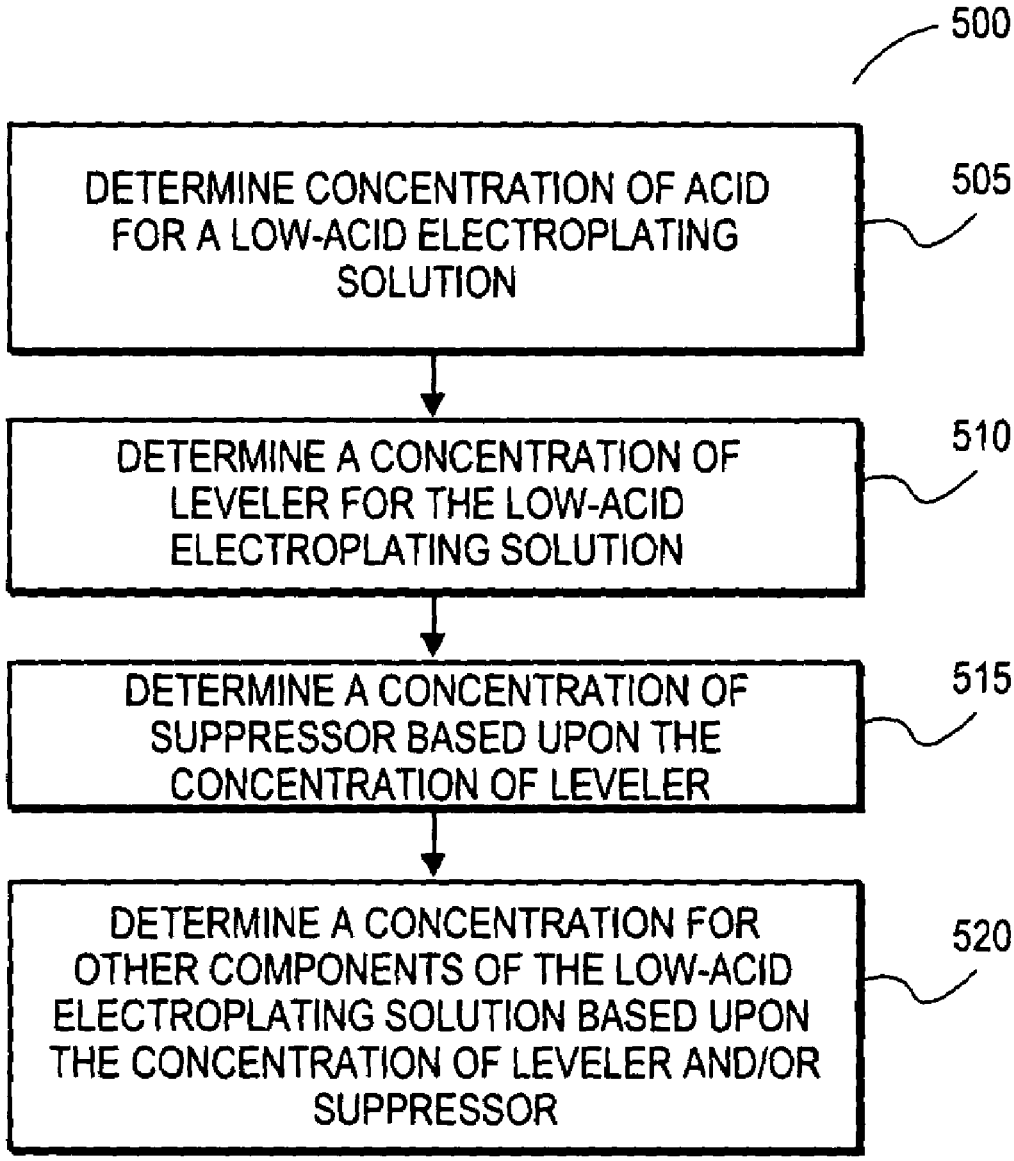
FIG. 5 illustrates a process in which component concentrations for a low-acid electroplating solution are determined in accordance with one embodiment of the present invention.

FIG. 5 illustrates a process in which component concentrations for a low-acid electroplating solution are determined in accordance with one embodiment of the present invention. Process 500, shown in FIG. 5, begins at operation 505 in which the concentration of acid is determined. For one embodiment, a decrease in acid concentration is accompanied by an increase in the concentration of the conductive metal (e.g., copper). This is because both the acid and the copper contribute to the conductivity of the electroplating solution; therefore, to maintain conductivity in a low-acid bath, an increase in copper in the solution is required. For one embodiment, the concentration of sulfuric acid is approximately 10 g/l and the concentration of copper is approximately 40 g/l.

At operation 510 the concentration of leveler is determined. In general, increased leveler concentration decreases WID thickness variation. Leveler concentration may be determined to reduce the WID thickness variation to a specified value. Such specified value may be selected based upon the requirements of the plating planarization processes. In an alternative embodiment, the amount and type of conductive metal is considered in determining the concentration of leveler. In accordance with one embodiment of the invention, the leveler concentration is determined to be greater than 12 ml/l. For one embodiment, the leveler concentration is approximately 15 ml/l.

At operation 515, the concentration of suppressor is determined. In accordance with one embodiment of the invention, the suppressor concentration is determined by considering the concentration of leveler to substantially reduce defects while maintaining WID thickness variations below a specified value. For one embodiment, the suppressor concentration is determined to be within the range of 3.3 ml/l-6.0 ml/l in conjunction with a leveler concentration within the range of 8 ml/l-12 ml/l. For one embodiment, the combined concentration of leveler and suppressor is limited by poor gap fill (occurrence of voids and seams) resulting from an excess of carbon in the solution. That is, the leveler and suppressor concentrations are determined as a maximum that will still affect proper (acceptable) gap-fill.

At operation 520 concentrations of other electroplating solution components (e.g., chloride and accelerator) are determined. As with a high-acid electroplating solution, the concentration of chloride may be increased to catalyze the suppressor. For one embodiment, the chloride concentration is determined as a minimum that will catalyze the suppressor to provide acceptable gap-fill. For one embodiment, the feature size and aspect ratio are considered in determining the chloride concentration. For one embodiment, the chloride concentration is within the range of 50 milligrams per liter ("mg/l")-65 mg/l.

For one embodiment, the concentrations of leveler and suppressor are considered in determining the concentration of accelerator. The accelerator, like the leveler and the suppressor, is an organic component. For one embodiment, the accelerator concentration is reduced to allow a maximum concentration of leveler and suppressor. For one embodiment, the accelerator concentration is approximately 1 ml/l for an electroplating solution having a leveler concentration of approximately 12 ml/l and a suppressor concentration of approximately 6 ml/l. For one embodiment, the feature size and aspect ratio are considered in determining the accelerator concentration.

It will be appreciated that embodiments of the invention may consist of less than all of the operations of process 500. For example, one embodiment of the invention consists of determining an increased level of suppressor to reduce defects.

General Matters

Embodiments of the invention provide methods for reducing electroplating defects by varying the concentration of leveler and suppressor in a low-acid electroplating solution. In one embodiment, the feature size may be considered in determining such concentrations. In alternative embodiments, various portions of the electroplating process, including electroplating current waveform, may also be considered in adjusting the concentration of solution components. In one embodiment, the temperature of the electroplating solution is elevated above 22° C. to increase electromigration resistance. For such an embodiment, the temperature of the electroplating solution is preferably within the range of 22° C.-30° C.

While embodiments of the invention have been described as applicable to wafers having relatively small feature sizes (i.e., less than 0.1 um), alternative embodiments of the invention are applicable to other feature sizes, larger or smaller. For example, wafers having larger features but, with relatively high aspect ratios, would benefit from embodiments of the invention.

Moreover, embodiments of the invention have been described in reference to an electroplating process using a copper electroplate and a silicon wafer. In alternative embodiments, the wafer could be any suitable material, including semiconductors and ceramics. Likewise, the electroplate may be any suitable material, including alloys of copper and sliver or gold, or multilayers of such materials.

While the invention has been described in terms of several embodiments, those skilled in the art will recognize that the invention is not limited to the embodiments described, but can be practiced with modification and alteration within the spirit and scope of the appended claims. The description is thus to be regarded as illustrative instead of limiting.

What is claimed is:

1. A method comprising:

determining a concentration of a conductive metal and of an acid for a low-acid electroplating solution;

determining a concentration of a leveler for the low-acid electroplating solution based upon the concentration of the conductive metal and the acid only after determining the concentration of the conductive metal and the acid such that the leveler concentration is sufficient to reduce a within die thickness variation to a specification value; and determining a concentration of a suppressor for the low-acid electroplating solution based upon the concentration of leveler only after determining the concentration of the leveler such that the concentration of the suppressor is sufficient to substantially reduce a number of electroplating defects while maintaining the within die thickness variation below the specification value;

evaluating the benefits of reducing the within die thickness variation with the detriments of increased defects when the concentration of the suppressor is increased, the concentration of the leveler and the suppressor are determined as maximum that effect a proper gap fill of a semiconductor wafer;

determining a concentration of a chloride for the low-acid electroplating solution such that the chloride concentration is sufficient to catalyze the suppressor, the concentration of the chloride determined as a minimum to catalyze the suppressor to provide the proper gap fill, the concentration of the chloride based on a feature size and an aspect ratio of the semiconductor wafer; and determining a concentration of an accelerator for the low-acid electroplating solution based upon the leveler concentration and the suppressor concentration only after determining the concentration of the suppressor and of the leveler, the concentration of the accelerator reduced to allow a maximum concentration of leveler and suppressor, the concentration of the accelerator based on the feature size and the aspect ratio of the semiconductor wafer, wherein the concentration of the leveler is at least about 12 ml/l.

2. The method of claim 1 wherein the conductive metal is copper and the concentration of the leveler is between about 15 ml/l and about 20 ml/l within the low-acid electroplating solution.

3. The method of claim 1 wherein a combined concentration of leveler and suppressor is determined to be below a specified value.

4. The method of claim 1 wherein the concentration of suppressor is within the range 1 ml/l -6 ml/l of suppressor within the low-acid electroplating solution.

5. The method of claim 1 wherein the accelerator concentration is in the range of 1 ml/l -3.3 ml/l of accelerator within the low-acid electroplating solution.

6. The method of claim 1 wherein the within die thickness variation is less than 2000 Angstroms.

7. The method of claim 1 wherein the number of electroplating defects is less than 100.

* * * * *